United States Patent [19]

Parslow et al.

[11] Patent Number: 4,661,289

[45] Date of Patent: Apr. 28, 1987

[54] DETERGENT COMPOSITIONS

[75] Inventors: Michael W. Parslow, Upton by Chester, United Kingdom; Jacobus R. Nooi, Hellevoetsluis, Netherlands

[73] Assignee: Lever Brothers Company, New York, N.Y.

[21] Appl. No.: 769,653

[22] Filed: Aug. 27, 1985

[30] Foreign Application Priority Data

Aug. 29, 1984 [GB] United Kingdom ..... 8421800

[51] Int. Cl.[4] ..... C11D 3/30; C11D 3/386; D06M 16/00

[52] U.S. Cl. ..... 252/547; 252/8.8; 252/174.12

[58] Field of Search ..... 252/174.12, 8.8, 547

[56] References Cited

U.S. PATENT DOCUMENTS

| | | | |
|---|---|---|---|
| 3,607,763 | 9/1971 | Salmen et al. | 252/137 |
| 3,644,203 | 2/1972 | Lamberti et al. | 252/8.75 |
| 3,886,075 | 5/1975 | Bernardino | 252/8.75 |
| 3,936,537 | 2/1976 | Baskerville et al. | 427/242 |
| 3,954,632 | 5/1976 | Gloss | 252/8.8 |
| 4,292,035 | 9/1981 | Battrell | 8/137 |
| 4,404,115 | 9/1983 | Tai | 252/135 |
| 4,464,272 | 8/1984 | Parslow et al. | 252/8.8 |
| 4,479,881 | 10/1984 | Tai | 252/8.8 |

FOREIGN PATENT DOCUMENTS

| | | |
|---|---|---|
| 0011340 | 5/1980 | European Pat. Off. . |
| 0026528 | 4/1981 | European Pat. Off. . |
| 7424119 | 6/1975 | France . |
| 1079388 | 8/1967 | United Kingdom . |
| 1514216 | 6/1978 | United Kingdom . |
| 2075028A | 11/1981 | United Kingdom . |
| 2095275A | 9/1982 | United Kingdom . |
| 2094826A | 9/1982 | United Kingdom . |

*Primary Examiner*—Robert A. Wax

*Attorney, Agent, or Firm*—Milton L. Honig; James J. Farrell

[57] ABSTRACT

The invention pertains to fabric-washing and -softening compositions comprising a combination of a cationic softening agent and a fungal cellulase. The compositions combine good cleaning performance with effective textile-softening performance on a wide range of natural and synthetic fibres.

5 Claims, No Drawings

DETERGENT COMPOSITIONS

This invention relates to detergent compositions that clean well and at the same time have a softening effect on textiles and fabrics.

Detergent compositions for simultaneously cleaning and softening fabrics are known in the art and various proposals have been made to formulate such detergent compositions.

Since the most commonly known commercially available organic textile-softening agents are cationic materials, numerous proposals have been made to incorporate a cationic fabric softener in a normally anionic surfactant-based detergent composition. However, the interference—inhibition—from anionic and cationic surface-active agents is known to constitute a major obstacle to the realisation of the simultaneous use of cationic and anionic surface-active agents. The reason for this interference or inhibition is that cationic materials are reactive towards the anionic surfactants present in conventional laundry detergents. If both types of oppositely charged materials are formulated in a single product, they tend to interact on addition to a wash liquor, forming insoluble inactive complexes. Obviously, much effort has been made in trying to overcome this problem, e.g. by the addition of compatibilising or solubilising compounds as described for example in U.S. Pat. Nos. 3,886,075 and 3,954,632, and French Pat. No. 7424119, none of which has resulted in a fully satisfactory product.

An alternative approach has been to incorporate one of the reactant materials in a form that inhibits its contact with the other in the wash liquor, and examples of formulations of this type are taught in U.S. Pat. Nos. 3,936,537 and 3,644,203. The performance of these compositions is, however, sensitive to the washing conditions that are employed. In an attempt to avoid the reactivity problem altogether, nonionic surfactants have been proposed in place of the conventional anionic surfactants, and compositions of this type are described in e.g. British Patent Specification 1,079,388 and U.S. Pat. No. 3,607,763. However, it has been found that levels of nonionic surfactant sufficient to provide good cleaning impair the softening of the cationic softener.

Later proposals to provide a fabric-softening effect in laundry detergent compositions have been directed to the use of alternative fabric-softening materials which are non-cationic in nature, e.g. certain long-chain water-insoluble tertiary amines that are nonionic in character at the wash liquor pH existing when a conventional laundry detergent is used, as described in British Patent Specification 1,514,216 and European Patent Applications 0011340 and 0026528.

However, these alternative fabric-softening materials are in themselves less effective than the conventional fabric-softening compounds.

A further proposal has been to use cellulolytic enzymes, i.e. cellulase, as a harshness-reducing agent, as disclosed in UK Patent Application GB 2 075 028 A, UK Patent Application GB 2 095 275 A and UK Patent Application GB 2 094 827 A.

Cellulase has a disadvantage in that it only exerts a softening effect on cellulosic fibres. Furthermore, if used on its own, cellulase requires a relatively high level of incorporation for effective single wash softening performance.

Still, it is beyond any doubt that cationic compounds are the most effective of all fabric-softening agents known so far.

It is therefore an object of the present invention to provide a textile-softening detergent composition containing a cationic fabric-softening compound having improved cleaning and softening effects on a wider range of natural and synthetic fibres, e.g. cotton, cotton/polyester mixtures, wool and synthetics such as acrylic etc.

It has now surprisingly been found that the above object can be achieved if the cationic fabric-softening compound is used in conjunction with a fungal cellulase as the essential fabric-softening ingredients.

According to the invention there is provided an improved alkaline detergent composition for the cleaning and softening of fabrics comprising:

(a) from 2 to 50% by weight of an anionic surfactant and/or a nonionic surfactant;

(b) from 0.5 to 15% by weight of a cationic fabric-softening compound; and (c) from 0 to 80% by weight of a detergency builder, characterised in that it contains a fungal cellulase as component (d).

Preferably component (a) is an anionic surfactant or a mixture of anionic and nonionic surfactants. Component (b) is preferably a di-tallowyl dimethyl ammonium halide, and component (d) is preferably an alkali cellulase having alkaline pH at its pH optimum.

In its broadest aspect the invention comprises three components, namely the anionic and/or nonionic surfactant component (a), the cationic fabric-softening compound (b), and the cellulase component (d).

(a) The Surfactant

A wide range of anionic surfactants can be used in the compositions of the present invention.

Suitable anionic non-soap surfactants are water-soluble salts of alkyl benzene sulphonates, alkyl sulphates, alkyl polyethoxy ether sulphates, paraffin sulphonates, alpha-olefin sulphonates, alpha-sulphocarboxylates and their esters, alkyl glyceryl ether sulphonates, fatty acid monoglyceride sulphates and sulphonates, alkyl phenol polyethoxy ether sulphates, 2-acyloxy-alkane-1-sulphonates, and beta-alkoxy alkane sulphonates. Soaps are also suitable anionic surfactants.

Especially preferred alkyl benzene sulphonates have about 9 to about 15 carbon atoms in a linear or branched alkyl chain, more especially about 11 to about 13 carbon atoms. Suitable alkyl sulphates have about 10 to about 22 carbon atoms in the alkyl chain, more especially from about 12 to about 18 carbon atoms. Suitable alkyl polyethoxy ether sulphates have about 10 to about 18 carbon atoms in the alkyl chain and have an average of about 1 to about 12 $—CH_2CH_2O—$ groups per molecule, especially about 10 to about 16 carbon atoms in the alkyl chain and an average of about 1 to about 6 $—CH_2CH_2O—$ groups per molecule.

Suitable paraffin sulphonates are essentially linear and contain from about 8 to about 24 carbon atoms, more especially from about 14 to about 18 carbon atoms. Suitable alpha-olefin sulphonates have about 10 to about 24 carbon atoms, more especially about 14 to about 16 carbon atoms; alpha-olefin sulphonates can be made by reaction with sulphur trioxide, followed by neutralization under conditions such that any sultones present are hydrolyzed to the corresponding hydroxy alkane sulphonates. Suitable alpha-sulphocarboxylates contain from about 6 to about 20 carbon atoms; included herein are not only the salts of alpha-sulphonated fatty acids, but also their esters made from alcohols containing about 1 to about 14 carbon atoms.

Suitable alkyl glyceryl ether sulphates are ethers of alcohols having about 10 to about 18 carbon atoms, more especially those derived from coconut oil and tallow. Suitable alkyl phenol polyethoxy ether sulphates have about 8 to about 12 carbon atoms in the alkyl chain and an average of about 1 to about 6 $—CH_2CH_2O—$ groups per molecule. Suitable 2-acyloxy-alkane-1-sulphonates contain from about 2 to about 9 carbon atoms in the acyl group and about 9 to about 23 carbon atoms in the alkane moiety. Suitable beta-alkyloxy alkane sulphonates contain about 1 to about 3 carbon atoms in the alkyl group and about 8 to about 20 carbon atoms in the alkane moiety.

The alkyl chains of the foregoing non-soap anionic surfactants can be derived from natural sources such as coconut oil or tallow, or can be made synthetically as for example by using the Ziegler or Oxo processes. Water-solubility can be achieved by using alkali metal, ammonium or alkanol-ammonium cations; sodium is preferred. Mixtures of anionic surfactants are contemplated by this invention; a satisfactory mixture contains alkyl benzene sulphonate having 11–13 carbon atoms in the alkyl group and alkyl sulphate having 12 to 18 carbon atoms in the alkyl group.

Suitable soaps contain about 8 to about 18 carbon atoms, more especially about 12 to about 18 carbon atoms. Soaps can be made by direct saponification or natural fats and oils such as coconut oil, tallow and palm oil, or by the neutralization of free fatty acids obtained from either natural or synthetic sources. The soap cation can be alkali metal, ammonium or alkanol-ammonium; sodium is preferred.

The compositions may contain from 0% to 50% of anionic detergent, preferably from 4% to 30% and normally from 5% to 15% of anionic detergent.

Nonionic surfactants may be incorporated in amounts of up to 100% by weight of the total surfactant, but normally are present in amounts of less than 75%. By total surfactant is meant the sum of the anionic surfactant and nonionic surfactant. Suitable nonionics are water-soluble ethoxylated materials of HLB 11.5–17.0 and include (but are not limited to) $C_{10}$–$C_{20}$ primary and secondary alcohol ethoxylates and $C_6$–$C_{10}$ alkylphenol ethoxylates. $C_{14}$–$C_{18}$ linear primary alcohols condensed with from seven to thirty moles of ethylene oxide per mole of alcohol are preferred, examples being $C_{14}$–$C_{15}$ $(EO)_7$, $C_{16}$–$C_{18}$ $(EO)_{25}$ and especially $C_{16}$–$C_{18}$ $(EO)_{11}$.

(b) The Cationic Fabric-Softening Compound

Among suitable cationic softeners are the conventional substantially water-insoluble quaternary ammonium compounds, and $C_{10-25}$ alkyl imidazolinium salts.

Well-known species of substantially water-insoluble quaternary ammonium compounds have the formula:

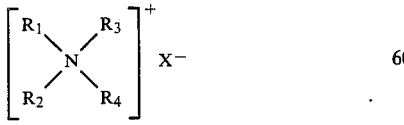

wherein $R_1$ and $R_2$ represent hydrocarbyl groups of from about 10 to about 22 carbon atoms; $R_3$ and $R_4$ represent hydrocarbyl groups containing from 1 to about 4 carbon atoms, X is any anion such as halide, a $C_2$–$C_{22}$ carboxylate, or an alkyl- or arylsulph(on)ate. Examples of preferred anions include bromide, chloride, methyl sulphate, toluene-, xylene-, cumene- and benzene-sulphonate, benzoate, p-hydroxybenzoate, acetate and propionate. Preferred quaternary ammonium softeners are the di($C_{16}$–$C_{20}$ alkyl)di($C_1$–$C_4$ alkyl) ammonium salts such as ditallow dimethyl ammonium chloride; ditallow dimethyl ammonium methyl sulphate; dihexadecyl dimethy ammonium chloride; di(hydrogenated tallow) dimethyl ammonium chloride; dioctadecyl dimethyl ammonium chloride; dieicosyl dimethyl ammonium chloride; dieocosyl ammonium chloride; di(hydrogenated tallow) dimethyl ammonium methyl sulphate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride and di(coconut alkyl) dimethyl ammonium chloride are preferred. Also suitable are the single long-chained quaternary ammonium compounds of the above formula wherein $R_1$ is $C_{10}$ to $C_{22}$ alkyl or alkenyl, preferably $C_{16}$ to $C_{20}$ alkyl, and $R_2$, $R_3$ and $R_4$ are lower alkyl groups, that is $C_1$ to $C_4$ alkyl groups, especially methyl, or aryl groups and X is as defined above. Optionally also two or all three of $R_2$, $R_3$ and $R_4$ may together represent a heterocyclic ring. Some representative examples of such compounds are lauryl trimethyl ammonium bromide, lauryl dimethyl benzyl ammonium chloride, myristyl dimethyl ethyl ammonium bromide, cetyl trimethyl ammonium bromide, behenyl trimethyl ammonium methosulphate, oleyl methyl diethyl ammonium chloride, cetyl stearyl or oleyl pyridinium chloride, behenyl pyridinium bromide, stearyl methyl morpholinium chloride, stearyl or oleyl ethyl or propyl morpholinium chloride.

Yet other quaternary ammonium cationic surfactants which may be mentioned have the formula:

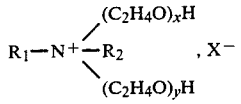

wherein $R_1$ and $R_2$ are as defined above or $R_2$ may be hydrogen and x and y are at least 1 and (x+y) is from 2 to 25. Examples are:

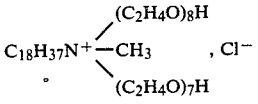

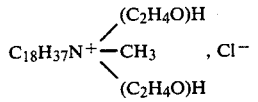

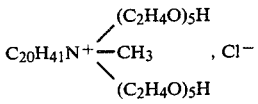

Substances of this sort are sold commercially, for instance under the Trade Name "Ethoquads".

Another class of suitable cationic surfactants can be represented by $C_{10}$–$C_{25}$ alkylimidazolinium salts. Preferred salts are those conforming to the formula:

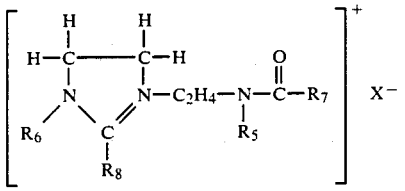

wherein $R_6$ is a $C_1$–$C_4$ alkyl radical, $R_5$ is hydrogen or a $C_1$–$C_4$ alkyl radical, $R_8$ is a $C_{10}$–$C_{25}$ alkyl radical and $R_7$ is hydrogen or a $C_{10}$–$C_{25}$ radical. X is a charge balancing ion which has the same meaning as X defined in the quaternary ammonium surfactant above.

A preferred member of this class, believed to be 1-methyl-2-tallowyl-3-(2-tallowamidoethyl-)imidazolinium chloride, is sold under the Trade Name Varisoft 455 or 475 (Ashland Chemical Company), or Steinoquat M5040/H (Chemische Werke Rewo).

Among other suitable cationic surfactants may be mentioned the substituted polyamine salts of general formula:

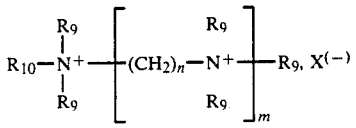

wherein $R_{10}$ is an alkyl or alkenyl group having from about 10 to 24, preferably 12 to 20, especially from 16 to 18 carbon atoms, the groups $R_9$ which may be the same or different, each represent hydrogen, a $(C_2H_4O)_pH$, or a $(C_3H_6O)_qH$, or a $C_1$–$C_3$ alkyl group wherein p and q may each be 0 or a number such that (p+q) does not exceed 25, n is an integer from 2 to 6, preferably 3, m is from about 1 to 9, preferably from 1 to 4, most preferably 1 or 2, and $X^{(-)}$ represents one or more anions having total charge balancing that of the nitrogen atoms.

Preferred compounds of this class are, most preferred, N-tallow-N,N',N'-trimethyl-1,3-propylene diamine dichloride or di-methosulphate, commercially available under the Trade Names Lilamine 540 EO-3 (Lilachem), Dinoramax SH3, Inopol ODX3 (Pierrefitte-Auby), and N-tallow-N,N,N',N'-pentamethyl-1,3-propylene diamine dichloride, commercially available under the Trade Names Stabiran MS-3 (Pierrefitte-Auby); Duoquad (Armour Hess); Adogen 477 (Ashland Company). Also suitable is the substance sold as Dinormac (Pierrefitte-Auby) or Duomac (Armour Hess) believed to have the formula:

$$\text{Tallowyl—}N^+H_2\text{—}(CH_2)_3\text{—}N^+H_3,\ 2(OCOCH_3)^-$$

or the corresponding chloride. Herein Tallowyl represents predominantly $C_{16}$ and $C_{18}$ alkyl groups derived from tallow fatty acids.

It is highly desirable when one or more of $R_9$ in these components is hydrogen, that the pH of the formulation be such that one or more of the nitrogen atoms is protonated.

Other suitable cationic softeners are described in U.S. Pat. No. 4,076,632 issued Feb. 28, 1978. Some suitable commercially available substances are marketed under the following Trade Names:

Sopa (Pierrefitte-Auby)
Sopapa (Pierrefitte-Auby)
Lilamin LS33 (Lilachim)
Polyram L 200 (Pierrefitte-Auby)
Taflon—302A (Daiichi Kogyo Seiyaku Co.).

Mixtures of two or more of these cationic softeners may be employed.

Preferred cationic softeners are ditallowyl dimethyl ammonium halides or methosulphate, and imidazolinium salts, e.g. Varisoft 455 or 475.

The compositions of the invention should contain from 0.5 to 15% by weight of the cationic fabric softener, preferably from 1.5 to 6%.

(d) The Cellulase

The cellulase usable in the present invention is a fungal cellulase having a pH optimum of between 5 and 11.5. It is, however, preferred to use fungal cellulases which have optimum activity at alkaline pH values, such as those described in UK Patent Application GB 2 075 028 A; UK Patent Appln GB 2 095 275 A and UK Patent Appln GB 2 094 826 A.

Examples of such alkaline cellulases are cellulases produced by a strain of *Humicola insolens* (*Humicola grisea* var. *thermoidea*), particularly the Humicola strain DSM 1800, and cellulases produced by a fungus of Bacillus N or a cellulase 212-producing fungus belonging to the genus Aeromonas.

The cellulase added to the composition of the invention may be in the form of a non-dusting granulate, e.g. "marumes" or "prills", or in the form of a liquid in which the cellulase is provided as a cellulase concentrate suspended in e.g. a nonionic surfactant or dissolved in an aqueous medium, having cellulase activity of at least 350 regular $C_x$ cellulase activity units/gram, measured under the standard conditions as described in GB 2 075 028 A.

The amount of cellulase in the composition of the invention will, in general, be from about 0.1 to 10% by weight in whatever form. In terms of cellulase activity the use of cellulase in an amount corresponding to from 0.25 to 150 or higher regular $C_x$ units/gram of the detergent composition is within the scope of the present invention. A preferred range of cellulase activity, however, is from 0.5 to 25 regular $C_x$ units/gram of the detergent composition.

OPTIONAL INGREDIENTS

The detergent compositions of the present invention mat of course include, as optional ingredients, components that are usually found in laundry detergents.

These include zwitterionic surfactants, detergency builder salts, bleaching agents and organic precursors therefor, suds depression agents, soil-suspending and anti-redeposition agents, other enzymes, e.g. proteolytic and amylolytic enzymes, optical brighteners, colouring agents and perfumes.

Detergency builder salts are a preferred component (c) of the compositions of the invention and can be inorganic or organic in character. Non-limiting examples of suitable water-soluble, inorganic alkaline detergent builder salts include the alkali metal carbonates, borates, phosphates, polyphosphates, bicarbonates and silicates. Specific examples of such salts include the sodium and potassium tetraborates, bicarbonates, carbonates, triphosphates, pyrophosphates, pentapolyphosphates and nexamethaphosphates. Sulphates are usually also present.

Examples of suitable organic alkaline detergency builder salts are:

(1) water-soluble amino polyacetates, e.g. sodium and potassium ethylenediaminetetraacetates, nitrilotriacetates, N-(2-hydroxyethyl)nitrilodiacetates and diethylene triamine pentaacetates;
(2) water-soluble salts of phytic acid, e.g. sodium and potassium phytates;
(3) water-soluble polyphosphonates, including sodium, potassium and lithium salts of methylenediphosphonic acid and the like and aminopolymethylene phosphonates such as ethylenediaminetetramethylene phosphonate and diethylene triaminepentamethylene phosphate, and polyphosphonates described in UK Patent Application GB 38724/77.
(4) water-soluble polycarboxylates such as the salts of lactic acid, succinic acid, malonic acid, maleic acid, citric acid, carboxymethylsuccinic acid, 2-oxa-1,1,3-propane tricarboxylic acid, 1,1,2,2-ethane tetracarboxylic acid, mellitic acid and pyromellitic acid.

Mixtures of organic and/or inorganic builders can be used herein. One such mixture of builders is disclosed in Canadian Patent Specification 755 038, e.g. a ternary mixture of sodium tripolyphosphate, trisodium nitrilotriacetate and trisodium ethane-1-hydroxy-1,1-diphosphonate.

Another type of detergency builder material useful in the present compositions and processes comprises a water-soluble material capable of forming a water-insoluble reaction product with water hardness cations preferably in combination with a crystallization seed which is capable of providing growth sites for said reaction product. Such "seeded builder" compositions are fully disclosed in British Patent Specification 1 424 406.

Preferred water-soluble builders are sodium tripolyphosphate and sodium silicate, and usually both are present. In particular, it is preferred that a substantial proportion, for instance from 3 to 15% by weight of the composition of sodium silicate (solids) of ratio (weight ratio $SiO_2$:$Na_2O$) from 1:1 to 3.5:1 be employed.

A further class of detergency builder materials useful in the present invention are insoluble sodium aluminosilicates, particularly those described in Belgian Patent Specification 814,874, issued Nov. 12, 1974. This patent specification discloses and claims detergent compositions containing sodium aluminosilicate of the formula:

$$Na_z(AlO_2)_z(SiO_2)_yxH_2O$$

wherein z and y are integers equal to at least 6, the molar ratio of z to y is in the range of from 1.0:1 to about 0.5:1 and x is an integer from about 15 to about 264. A preferred material is $Na_{12}(SiO_2AlO_2)_{12}27H_2O$. About 5% to 25% by weight of aluminosilicate may be used as a partial replacement for water-soluble builder salts, provided that sufficient water-soluble alkaline salts remain to provide the specified pH of the composition in aqueous solution.

The detergent builder salts are normally included in amounts of from 10% to 80% by weight of the composition, preferably from 20% to 70% and most usually from 30% to 60% by weight.

Bleaching agents useful in the compositions of the invention include sodium perborate, sodium percarbonate and other perhydrates at levels of from 5% to 35% by weight of the composition. Organic peroxy bleach precursors such as tetra acetyl ethylene diamine and tetra acetyl glycoluril can also be included and these and other precursors are disclosed in German Patent Application No. 2 744 642.

In compositions incorporating oxygen bleaches, bleach stabilisers are also preferred components, usually at levels of from 0.2% to 2% by weight of the composition. The stabilisers may be organic in nature, such as the previously mentioned aminopolyacetates and aminopolyphosphonates, or may be inorganic, such as magnesium silicate. In the latter case the material may be added to the formulation or formed in situ by the addition of a water-soluble magnesium salt to a slurried detergent mix containing an alkali metal silicate.

Suds-controlling agents are often present. These include suds-boosting or suds-stabilising agents such as mono- or diethanolamides of fatty acids. More often in modern detergent compositions, suds-depressing agents are required. Soaps, especially those having 18 carbon atoms, or the corresponding fatty acids, can act as effective suds depressors if included in the anionic surfactant component of the present compositions. Usually about 1% to about 4% of such soap is effective as a suds suppressor. Very suitable soaps, when suds suppression is a primary reason for their use, are those derived from Hyfac (Trade Name for hardened marine oil fatty acids, predominantly $C_{18}$ to $C_{22}$ acids available from the Humko Corporation).

However, non-soap suds suppressors are preferred in synthetic detergent-based compositions of the invention, since soap or fatty acid tends to give rise to a characteristic odour in these compositions.

Preferred suds suppressors comprise silicones. In particular there may be employed a particulate suds suppressor comprising silicone and silanated silica releasably enclosed in water-soluble or -dispersible substantially non-surface-active detergent impermeable carrier. Suds-depressing agents of this sort are disclosed in British Patent Specification 1 407 997. A very suitable granular (prilled) suds-depressing product comprises 7% silica/silicone (15% by weight silanated silica, 85% silicone, obtained from Messrs Dow Corning), 65% sodium tripolyphosphate, 25% tallow alcohol condensed with 25 molar proportions of ethylene oxide, and 3% moisture. The amount of silica/silicone suds-suppressor employed depends upon the degree of suds suppression desired, but it is often in the range of from 0.01% to 0.5% by weight of the detergent composition. Other suds suppressors which may be used are water-insoluble, preferably microcrystalline, waxes having a melting point in the range of from 35° to 125° C. and a saponification value of less than 100, as described in British Patent Specification 1 492 938.

Yet other suitable suds-suppressing systems are mixtures of hydrocarbon oil, a hydrocarbon wax and hydrophobic silica as described in European Patent Application No. 78 2000 035 and, especially, particulate suds-suppressing compositions comprising such mixtures, combined with an HLB in the range of from 14 to 19 and a compatibilising agent capable of forming inclusion compounds, such as urea. These particulate suds-suppressing compositions are described in European Patent Application 0 00 8830.

Soil-suspending agents are usually present at about 0.1 to 10%, such as water-soluble salts of carboxymethylcellulose, carboxyhydroxymethyl cellulose, polyethylene glycols of molecular weight of from about 400 to 10,000 and copolymers of methylvinylether and maleic anhydride or acid, available under the Trade Name Gantrez.

Proteolytic or amylolytic enzymes, especially proteolytic, and optical brighteners of anionic, cationic or nonionic types, especially the derivatives of sulphonated triazinyl diamino stilbene may be present.

Photoactivated bleaches such as the tri- and tetra-sulphonated derivatives of zinc phthalocyanine are also useful components of the present composition.

Colours, non-substantive, and perfumes, as required to improve the aesthetic acceptability of the product, are usually incorporated.

Throughout the description herein where sodium salts have been referred to, potassium, lithium or ammonium or amine salts may be used instead if their extra cost etc. are justified for special reasons.

PREPARATION OF THE COMPOSITIONS

The detergent compositions may be prepared in any way appropriate to their physical form, such as by dry-mixing the components, co-agglomerating them or dispersing them in a liquid carrier. However, a preferred physical form is a granule incorporating a detergency builder salt and this is most conveniently manufactured by spray-drying at least part of the composition. For the purpose of the following discussion, components of the composition that are normally added to a detergent crutcher mix and spray-dried are identified as (a), components which are applied in the liquid form by spray-on to other solid components are identified as (b) and components which are added as solids other than in the spray-dried portion are identified as (c).

Conventionally, the compositions are prepared by making up an aqueous slurry of the non-heat-sensitive components (a), comprising the anionic and/or non-ionic surfactants, builder and filler salts together with any soil-suspending agents and optical brighteners, and spray-drying this slurry. The moisture content of the slurry is normally in the range of 28% to 36% and its temperature is conveniently in the range of 70° to 90° C. The spray-drying tower inlet temperatures are normally in the range of 300° to 360° C. and the resultant spray-dried granules have a moisture content of 8–12% by weight. An optional, but preferred, additional processing step is to cool the dried granules rapidly by means of cool air from a temperature of 90° C. to a temperature in the range of 25° to 35° C., in order to facilitate the further processing of the product. Solid heat-sensitive components (c), such as persalts and enzymes, are mixed with the spray-dried granules. Although the water-insoluble cationic component may be included in the slurry for spray-drying, it may degrade under certain processing conditions and adversely affect product quality. It is therefore preferred that the water-insoluble cationic material be added as a dry particulate solid to the spray-dried granules before or after other heat-sensitive solids have been dry-mixed with them.

If the cationic is applied as a melt, a liquid temperature of 5° to 30° C. in excess of the melting point can conveniently be used for the spray-on. When the cationic is a solid of rather high melting point, it may be necessary to blend it with a compatible lower melting substance so as to ensure that granules sprayed on therewith are sufficiently crisp, are free-flowing and do not cake on storage.

The invention is illustrated by the following non-limiting examples.

Example I

A detergent powder of the following composition was prepared by spray-drying:

| | |
|---|---|
| Sodium linear $C_{12}$ alkyl benzene sulphonate | 5.5% |
| $C_{13}$–$C_{15}$ alcohol/11 ethylene oxide condensate | 3.0% |
| Sodium soap | 2.0% |
| Sodium triphosphate | 30.0% |
| Sodium silicate | 5.0% |
| Sodium sulphate | 8.0% |
| Water and minor ingredients | 11.5% |

where the percentages quoted are based on the weight of the final product. To this spray-dried base powder was added 21% of sodium perborate tetrahydrate and 14% of sodium sulphate. This composition was used as a control. Further compositions were prepared which included a tertiary amine (Armeen ®M2HT ex Akzo N.V.), cationic fabric softener (Ditallowyl dimethyl ammonium chloride) and fungal cellulase as set out below. These components were added to the spray-dried base powder granules and the level of post-dosed sodium sulphate in the base powder was reduced accordingly.

| Example No | Control | A | B | C | D | I |
|---|---|---|---|---|---|---|
| amine | — | 4% | — | — | 4% | — |
| cationic | — | — | 4% | — | — | 4% |
| cellulase* | — | — | — | [60] | [60] | [60] |

*cellulase level added to give 60 $C_x$ units/l in the wash.
Cellulase SP227 derived from a strain of Humicula Insolens, supplied by NOVO Industries as encapsulated T-granulate, having activity Of 650 $C_x$ units/g measured at pH 8.5.

These compositions were then used to wash pre-harshened terry towelling and acrylic monitors. The product dosage was 5 g/l, the water hardness was 8° German Hardness and the pH of the wash liquor was approximately 9.3. A Miele ®W406 TMT automatic washing machine was used on a 25° C. to 40° C. heat-up cycle, heating up at 2° C./min. The wash time was 35 minutes. After washing, the monitors were rinsed 3 times in tap water (1:5), line dried and then assessed for softness using a laboratory softness-measuring device. The results, expressed in relative harshness (%), were as set out in the following Table 1, the softness of the monitors washed once in the control formulation being taken as 100%. Hence, lower figures show better softening.

TABLE 1

| | Relative harshness (%) | | | |
|---|---|---|---|---|
| | Terry towelling | | Acrylic | |
| Example No | After 1 wash | After 5 washes | After 1 wash | After 5 washes |
| Control | 100 | 102 | 100 | 87 |
| A | 96 | 102 | 93 | 83 |
| B | 96 | 84 | 87 | 74 |
| C | 93 | 89 | 101 | 86 |
| D | 94 | 86 | 92 | 82 |
| I | 91 | 78 | 84 | 71 |

A comparison of the results shows that the use of a cationic fabric-softening compound and cellulase together of Example I gives a softening benefit which is greater than the use of each softening compound alone (Examples A, B and C) or the use of a combination of amine+cellulase (Example D).

EXAMPLE II

The following compositions were made up:

| % by weight | A | B | C | II |
|---|---|---|---|---|
| Sodium linear $C_{12}$ alkyl benzene sulphonate | 6.0 | 6.0 | 6.0 | 6.0 |
| $C_{13-15}$ fatty alcohol condensed with 11 ethylene oxide units | 3.0 | 3.0 | 3.0 | 3.0 |
| Sodium soap | 2.0 | 2.0 | 2.0 | 2.0 |
| Sodium triphosphate | 33.0 | 33.0 | 33.0 | 33.0 |
| Sodium silicate (1:2) | 6.0 | 6.0 | 6.0 | 6.0 |
| Optical brightener | 0.2 | 0.2 | 0.2 | 0.2 |
| Sodium sulphate | — | — | — | 11.9 |
| Sodium perborate tetrahydrate | 24.0 | 24.0 | 24.0 | 24.0 |
| Cationic distearyl dimethyl ammonium chloride | 4.0 | — | — | 4.0 |
| Fungal cellulase (420 reg. $C_x$ units/g) | — | 0.8 | 1.8 | 0.8 |
| Moisture & miscellaneous | 9.1 | 9.1 | 9.1 | 9.1 |

The compositions were used to wash pre-harshened cotton terry towelling monitors, i.e. 30×prewashed at 90° C. in a Brandt® washing machine. The washing experiments were conducted in Tergotometers at 40° C. The conditions were a 30 minute wash with 4 g/l product in 24° H water at a liquor:cloth ratio of 20:1.

The softening effects achieved after a single wash, 3 washes and 5 washes were assessed by four independent judges using a ranking difference method and the resulting scores converted to a percentage of the rinse conditioner delivery under the same conditions (higher figures showing better softening benefit).

The results were as set out in the following Table 2.

TABLE 2

| Example No | Single wash | After 3 washes | After 5 washes |
|---|---|---|---|
| A | 34 | 52 | 33 |
| B | −12 | 16 | 4 |
| C | −2 | 13 | −14 |
| II | 57 | 61 | 75 |

A comparison of the results shows that Example II, containing 4% cationic+0.8% cellulase, of the invention gives a softening benefit which is much greater than that of composition A using 4% cationic alone, of composition B using 0.8% cellulase alone, and composition C using 1.8% cellulase alone.

What is claimed is:

1. An alkaline detergent composition for the cleaning and softening of fabrics comprising:

(a) from 2 to 50% by weight of a detergent surfactant selected from the group consisting of anionic, nonionic surfactants and mixtures thereof;

(b) from 1.5 to 6% by weight of a cationic fabric-softening compound;

(c) from 0 to 80% by weight of a detergency builder, and (d) from 0.1 to 10% by weight of a fungal cellulase, comprising the cellulase in an amount corresponding to from about 4 to about 150 regular $C_x$ units/gram of the detergent composition.

2. A composition according to claim 1, comprising a fungal cellulase having an optimum activity at alkaline pH values.

3. A composition according to claim 1, wherein the cationic compound is a di($C_{16}$–$C_{20}$ alkyl) di($C_1$–$C_4$ alkyl) ammonium salt.

4. A composition according to claim 1, wherein the cationic compound is a $C_{10}$–$C_{25}$ alkyl imidazolinium salt corresponding to the formula:

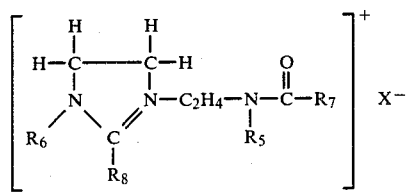

wherein $R_6$ is a $C_1$–$C_4$ alkyl radical, $R_5$ is hydrogen or a $C_1$–$C_4$ alkyl radical, $R_8$ is a $C_{10}$–$C_{25}$ alkyl radical and $R_7$ is hydrogen or a $C_{10}$–$C_{25}$ radical, X being a charge balancing anion.

5. A composition according to claim 1, which comprises 5 to 15% by weight of the anionic surfactant.

* * * * *